US007857094B2

(12) United States Patent
Macquisten et al.

(10) Patent No.: US 7,857,094 B2
(45) Date of Patent: Dec. 28, 2010

(54) COMBUSTION CHAMBER FOR A GAS TURBINE ENGINE

(75) Inventors: Michael A Macquisten, Derby (GB); Anthony J Moran, Nuneaton (GB); Michael Whiteman, Loughborough (GB); Jonathan F Carrotte, Leicester (GB); Ashley G Barker, Loughborough (GB)

(73) Assignee: Rolls-Royce plc, London (GB)

( * ) Notice: Subject to any disclaimer, the term of this patent is extended or adjusted under 35 U.S.C. 154(b) by 866 days.

(21) Appl. No.: 11/806,366

(22) Filed: May 31, 2007

(65) Prior Publication Data

US 2008/0087019 A1 Apr. 17, 2008

(30) Foreign Application Priority Data

Jun. 1, 2006 (GB) ..... 0610800.5

(51) Int. Cl.

| | |
|---|---|
| ***F01N 1/02*** | (2006.01) |
| ***F02C 7/045*** | (2006.01) |
| *F01N 1/00* | (2006.01) |
| *F02C 7/24* | (2006.01) |
| *F23M 5/06* | (2006.01) |

(52) U.S. Cl. ..... 181/250; 60/725; 431/114

(58) Field of Classification Search ..... 181/250, 181/266, 273, 276; 123/184.53, 184.57; 60/312, 322, 725; 431/114

See application file for complete search history.

(56) References Cited

U.S. PATENT DOCUMENTS

| | | | | |
|---|---|---|---|---|
| 5,373,695 | A | 12/1994 | Aigner | |
| 5,644,918 | A | 7/1997 | Gulati | |
| 6,430,933 | B1 * | 8/2002 | Keller | 60/772 |
| 6,464,489 | B1 * | 10/2002 | Gutmark et al. | 431/1 |
| 7,013,634 | B2 * | 3/2006 | Pidcock et al. | 60/39.821 |
| 7,076,956 | B2 * | 7/2006 | Young et al. | 60/725 |
| 7,331,182 | B2 * | 2/2008 | Graf et al. | 60/725 |
| 7,448,215 | B2 * | 11/2008 | Macquisten et al. | 60/725 |
| 7,546,739 | B2 * | 6/2009 | Holland et al. | 60/772 |
| 7,770,694 | B2 * | 8/2010 | Baars et al. | 181/250 |
| 2004/0248053 | A1 * | 12/2004 | Benz et al. | 431/114 |
| 2005/0223707 | A1 * | 10/2005 | Ikeda et al. | 60/725 |
| 2006/0032699 | A1 * | 2/2006 | Kyu | 181/250 |
| 2008/0216481 | A1 * | 9/2008 | Pollarolo | 60/725 |
| 2009/0236172 | A1 * | 9/2009 | Ross et al. | 181/204 |

FOREIGN PATENT DOCUMENTS

| | | | |
|---|---|---|---|
| DE | 19640980 AB | | 4/1998 |
| DE | 10 2004 010 620 | A | 9/2004 |
| EP | 576717 | A1 * | 1/1994 |
| EP | 1 605 209 | A | 12/2005 |
| GB | 2 288 660 | A | 10/1995 |
| GB | 2 396 687 | A | 6/2004 |

* cited by examiner

*Primary Examiner*—Edgardo San Martin
(74) *Attorney, Agent, or Firm*—Jeffrey S. Melcher; Manelli Denison & Selter PLLC

(57) ABSTRACT

A combustion chamber for a gas turbine engine comprising at least one Helmholtz resonator having a resonator cavity and a resonator neck in flow communication with the interior of the combustion chamber. The cavity extends around at least part of the neck and is spaced apart therefrom to define a cooling chamber therebetween. The cooling chamber allows the neck and the cavity to be cooled with a flow of cooling air. The sunken neck allows the resonator to be located within enclosures with minimal volume without compromising on the damping properties afforded.

7 Claims, 3 Drawing Sheets

COMBUSTION CHAMBER FOR A GAS TURBINE ENGINE

CROSS-REFERENCE TO RELATED APPLICATIONS

This application claims priority to Great Britain patent application No. GB 0610800.5, filed 1 Jun. 2006.

FIELD OF THE INVENTION

This invention relates to combustion chambers for gas turbine engines, and in particular lean burn, low emission combustion chambers having one or more resonator chambers for damping pressure fluctuations in the combustion chamber in use.

BACKGROUND OF THE INVENTION

Lean burn, low emission gas turbine engine combustors of the type now being developed for future engine applications have a tendency, under certain operating conditions, to produce audible pressure fluctuations which can cause premature structural damage to the combustion chamber and other parts of the engine. These pressure fluctuations are audible as rumble which occurs as a result of the combustion process.

Pressure oscillations in gas turbine engine combustors can be damped by using damping devices such as Helmholtz resonators, preferably in flow communication with the interior of the combustion chamber or the gas flow region surrounding the combustion chamber.

The use of Helmholtz resonators has been proposed in a number of earlier published patents including for example U.S. Pat. No. 5,644,918 where a plurality of resonators are connected to the head end, that is to say the upstream end, of the flame tubes of an industrial gas turbine engine combustor. This type of arrangement is particularly suitable for industrial gas turbine engines where there is sufficient space at the head of the combustor to install such damping devices. The combustor in a ground based engine application can be made sufficiently strong to support the resonators and the vibration loads generated by the resonators in use. This arrangement is not practicable for use in aero engine applications where space, particularly in the axial direction of the engine, is more limited and component weight is a significant design consideration.

A different approach to combustion chamber damping is therefore required for aero engine applications where space is more limited and design constraints require that the resonators are supported with respect to the combustion chamber without adding appreciably to the weight of the combustion chamber itself.

One form of Helmholtz resonator that is particularly suitable for a combustion chamber for aero engine applications is described in EP 1,424,006A2. The arrangement provides at least one Helmholtz resonator having a resonator cavity and a neck in flow communication with the interior of the combustion chamber, the neck having at least one cooling hole extending through the wall thereof. The cooling hole directs a film of cooling air on the inner surface of the tube wall in the region of the combustor opening, the film protecting the tube from the effects of the high temperature combustion gasses entering and exiting the resonator neck during unstable combustor operations.

It has now been found that at certain operating conditions the resonator body can overheat despite the presence of a cooling flow through holes in the neck of the resonator. This arises due to the movement of hot gases into, and out of, the resonator neck when pressure oscillations inside the combustor are relatively high. In addition, it is thought the holes angled towards the combustion chamber can induce a flow which draws hot combustion gases into the neck and resonator body.

Within the combustor, as discussed above, space available is often insufficient to place a conventionally structured Helmholtz resonator, which has a resonator cavity and a neck that extends therefrom. The limited space may require such resonators to be located away from their optimum point, or to have shortened necks, or to have resonator cavities of a volume that is not optimum for the frequency oscillation to be damped.

Because of the size of the conventionally structured Helmholtz resonators they are typically mounted radially inwardly of the wall of the combustion chamber and are typically mounted to the inner casing to avoid loads being transmitted to the combustion chamber itself. This positioning places the resonators close to the engine shaft where there can be problems with windage that require the resonator to be mounted within an isolating enclosure that reduces the windage effects. It will be appreciated that the isolating enclosure adds cost and weight to an engine.

It is an object of the present invention to seek to provide an improved damper arrangement for a combustion chamber.

SUMMARY OF THE INVENTION

According to the invention there is provided a combustion chamber for a gas turbine engine comprising at least one Helmholtz resonator having a resonator cavity and a resonator neck in flow communication with the interior of the combustion chamber, wherein the cavity extends around at least part of the neck and is spaced apart therefrom to define a cooling chamber therebetween.

In preferred embodiment the cooling chamber has a closed end and an open end. Preferably the closed end has at least one purging hole that in use directs a flow of purging air into the cavity. The open end may have at least one cooling hole that directs a flow of cooling air from the cooling chamber into the resonator neck.

This arrangement provides cooling air directed at, or towards the resonator cavity. The direction of air can prevent overheating of both the resonator neck and the cavity. The arrangement resists the ingestion of hot combustor gasses into the resonator cavity. It is to be understood that the term "cooling hole" used herein refers to any type of aperture through which cooling air or other fluid can pass.

The holes in the resonator neck closest to the combustion chamber are preferably configured for damping, the velocity and volume of the air being selected to create a shedding vortex within the combustor.

For the avoidance of doubt the term "combustion chamber" used herein is used interchangeably with the term "combustor" and reference to one include reference to the other.

BRIEF DESCRIPTION OF THE DRAWINGS

Various embodiments of the invention will now be more particularly described, by way of example only, with reference to the accompanying drawings in which.

DETAILED DESCRIPTION OF THE INVENTION

Figure 1:
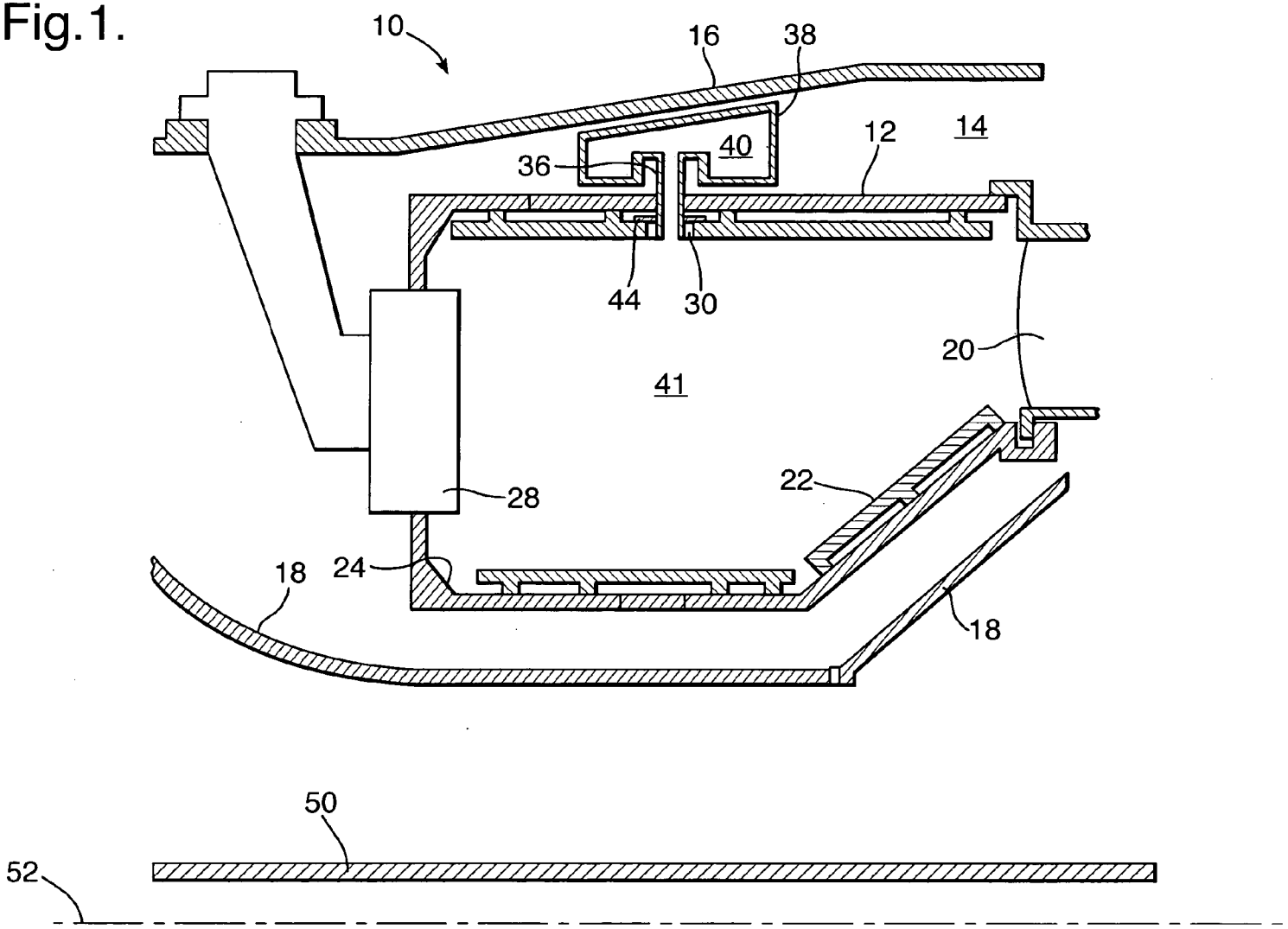
FIG. 1 is an axisymmetric view of a gas turbine engine combustion chamber showing a Helmholtz resonator in flow communication with the interior of the chamber.
Figure 2:
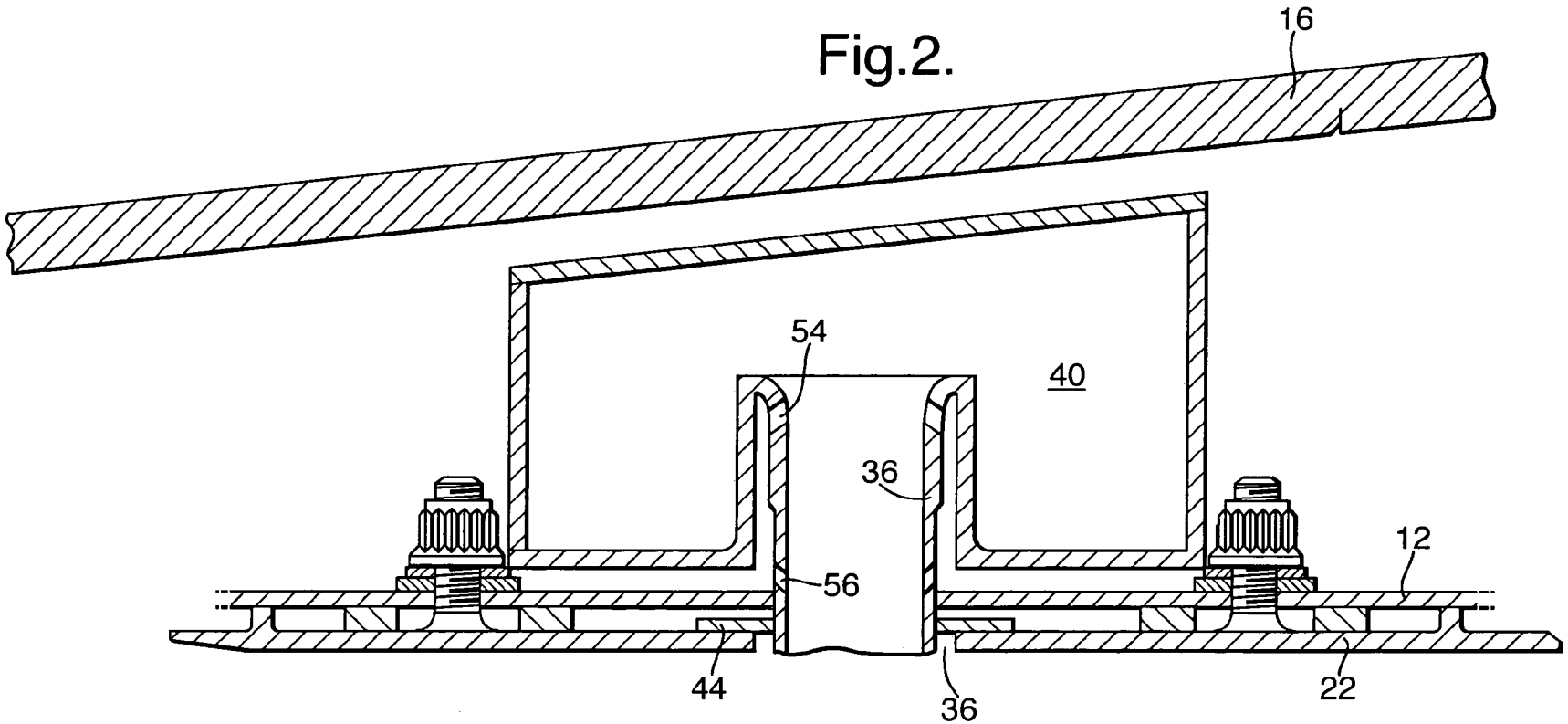
FIG. 2 is an enlarged view of the resonator of FIG. 1.

Referring to FIG. 1, the combustion section 10 of a gas turbine aero engine is illustrated with the adjacent engine parts omitted for clarity, that is the compressor section upstream of the combustor (to the left of the drawing in FIG. 1) and the turbine section downstream of the combustion section. The combustion section comprises an annular type combustion chamber 12 positioned in an annular region 14 between a combustion chamber outer casing 16, which is part of the engine casing structure and radially outwards of the combustion chamber, and a combustion chamber inner casing 18, also part of the engine structure and positioned radially inwards of the combustion chamber 12. The inner casing 16 and outer casing 18 comprise part of the engine casing load bearing structure and the function of these components is well understood by those skilled in the art. The combustion chamber 12 is cantilevered at its downstream end from an annular array of nozzle guide vanes 20, one of which is shown in part in the drawing of FIG. 1. In this arrangement the combustion chamber may be considered to be a non load bearing component in the sense that it does not support any loads other than the loads acting upon it due to the pressure differential across the walls of the combustion chamber.

The combustion chamber comprises a continuous heat shield type lining on its radially inner and outer interior surfaces. The lining comprises a series of heat resistant tiles 22 which are attached to the interior surface of the radially inner and outer walls of the combustor in a known manner. The upstream end of the combustion chamber comprises an annular end wall 24 which includes a series of circumferentially spaced apertures for receiving respective air fuel injection devices 28.

The radially outer wall of the combustion chamber is provided with a plurality of circumferentially spaced apertures 30 for receiving the end part of a Helmholtz resonator resonator neck 36. Each Helmholtz resonator 38 comprises a box like resonator cavity 40 which is in flow communication with the interior of the combustion chamber through the resonator neck 36 which extends radially from the resonator cavity 40 into the interior 41 of the combustor.

In this embodiment the resonator neck has a substantially circular cross section although tubes having cross sections other than circular may be used. An annular sealing member 44 is provided around the outer periphery of the tube to provide a gas tight seal between the tube and the opening 30. The tube provides for limited relative axial movement of the tube with respect to the combustion chamber so that substantially no load is transferred from the resonator tube to the combustion chamber during engine operation.

The resonator is mounted on the outer wall of the combustion chamber where, as can be seen from FIG. 1, there is limited space between the combustor wall 12 and the outer casing 16. To avoid the necessity of reducing the volume of the resonator cavity and/or the neck of the cavity to allow such a placement in the embodiment shown the neck is sunk into the cavity whilst maintaining a gap between the wall of the cavity and the wall of the resonator neck that allows cooling and purging air to be supplied to both the neck and the cavity.

The cavity end of the neck is formed to be continuous with the wall of the cavity. To avoid the generation of a hot spot the junctions have a fillet radius rather than a 90° angle. The fillet radius is not so large as to increase unduly the mass at the centre of the junction.

In the embodiment shown the radially outer wall of the cavity is angled such that it can be located within the sloping outer wall 16 of the combustor casing.

The resonator neck has a circular cross section with a plurality of circumferentially spaced cooling holes 54 formed in the tube wall. The cooling holes 54 are equally spaced around the tube circumference and are inclined with respect to respective lines tangential to the tube circumference at the hole locations. A single row of 20, 0.5 mm diameter holes is provided, positioned in the half of the neck 36 closest to the resonator cavity and about quarter of the way along the neck from the cavity, each of the holes having an axis angled towards the resonator cavity 40. The angle 64 formed between the hole axis and the axis 60 of the resonator neck 36 is of the order 30°. The holes have a swirl angle of 45°. In use, the resonator is thus continually purged with cooling air passing through the array of holes 54. The purging air keeps the resonator cavity at a temperature at which no thermal damage occurs and beneficially creates a flow of air in the neck that travels from the cavity to the combustion chamber both cooling the neck and preventing ingestion of hot combustor gasses.

A second row 56 of holes is provided in an axially spaced relation with the first row of holes 54, along the length of the neck and is positioned closer to the end of the neck that opens into the combustion chamber than the first row of holes 54. The second row of holes consists of twenty 0.5 mm diameter holes. The holes have an axis that is angled 17° with respect to the longitudinal axis of the neck and directed towards the combustor chamber, the holes also have a swirl angle of 20°.

The relative swirl angles create a tangential component with respect to the circumference of the tube. This promotes vortex flow on the interior surface of the tube when cooling air passes from the exterior region of the tube into the interior region thereof.

The reduced swirl component of the holes 56 closest to the combustion chamber allows the flow of air to adhere to the inner wall of the resonator neck. The adherence improves the vortex shedding at the combustor opening and consequently the damping achieved by the resonator. Additionally, because cool air is entering the neck and the cavity from the purging holes the volume of the air passing through the cooling holes closest to the combustor chamber can be reduced such that the efficiency of the damper is enhanced.

It has been found that the hot gases can be induced into the resonator neck and cavity in the absence of purging holes. In the present embodiment, the presence of a row of holes angled towards the resonator cavity induces a flow of air into the cavity and then along the resonator neck which inhibits the flow of hot gases within the neck.

Figure 3:
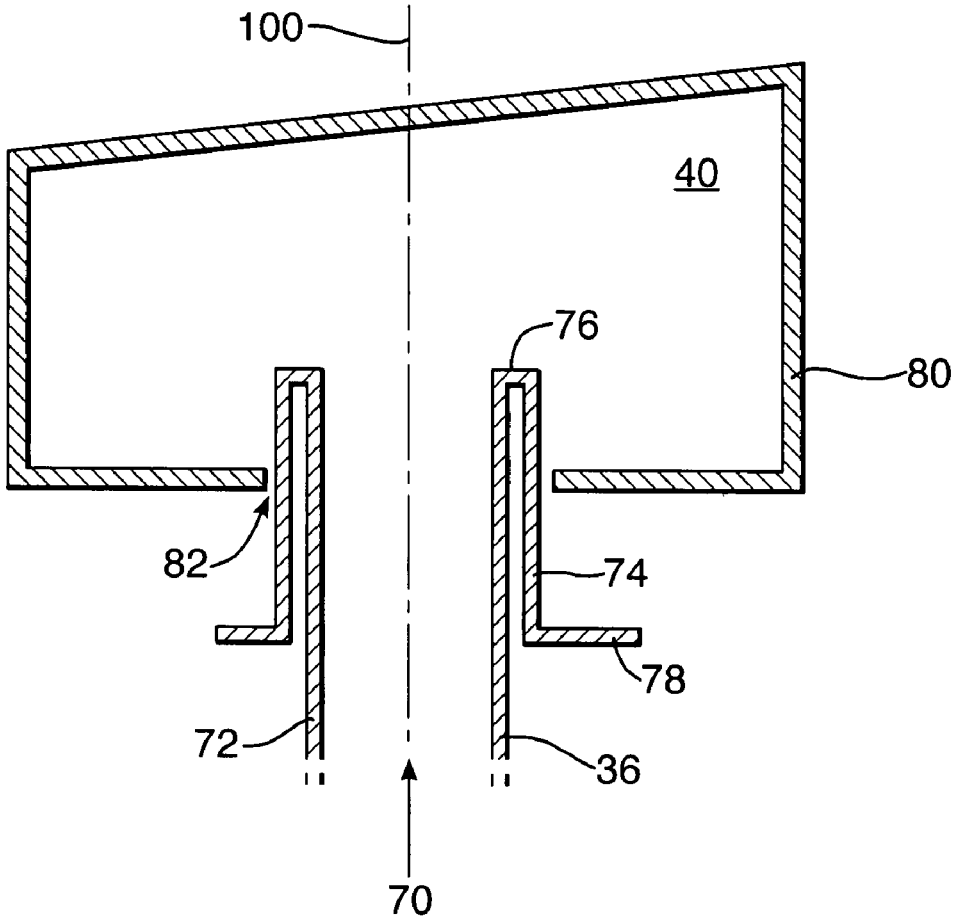
FIG. 3 is an alternative embodiment of the resonator of the present invention.

In an alternative arrangement depicted with respect to FIG. 3, the resonator neck and the resonator cavity may be formed as separate components and joined together. The neck has an inner wall 72 that extends around an axis 100 and an outer wall 74 coaxial with the inner wall. The outer wall 74 has at one end an inwardly extending radial flange that joins the outer wall 74 with the inner wall 72 and at the other end a radially outwardly extending flange 78 that is used to connect the neck with the cavity wall 80.

Beneficially, this arrangement allows resonator necks to be simply and easily changed to alter the damping characteristics of the resonator. For example, an existing neck (not shown) may be removed and the new neck inserted into the aperture 82 of the cavity 40 in the direction of arrow 70. The flange abuts the cavity wall and may be joined by welding or more preferably through a nut and bolt type fixing (not shown). The outer wall 74 of the resonator neck provides one wall of the resonator cavity 40.

In use, a number of resonators 38 are positioned around the combustion chamber outer casing 12. The resonators have different circumferential dimensions such that the volume of the respective cavities 40 of the resonators is different for each resonator. This difference in cavity volume has the effect of ensuring each resonator has a different resonator frequency such that the respective resonators 38 compliment one another in the sense that collectively the resonators operate over a wide frequency band to damp pressure oscillations in the combustion chamber over substantially the entire running range of the engine. Each resonator has a particularly frequency and the resonator cavities 40 are sized such that the different resonator frequencies do not substantially overlap. The axial location of the resonators can be different, as can the circumferential spacing between adjacent resonators.

Although aspects of the invention have been described with reference to the embodiments shown in the accompanying drawing, it is to be understood that the invention is not limited to those precise embodiments and that various changes and modifications may be effected without further inventive skill and effort. For example, other hole configurations may be used including arrangements where the holes are arranged in several rows, in line, or staggered with respect to each other, with different diameters, number of holes and angles depending on the specific cooling requirements of the particular combustion chamber application. In addition, different shaped holes may be employed instead of substantially circular cross section holes.

It will be appreciated that Helmholtz resonators according to the invention can have both asymmetric volumes and sunken necks which enable the device to be situated in locations unsuitable for conventional Helmholtz resonators. The resonator cavity may be shaped to fit in and around other components and may have indentations or the such like to enable placement regardless of the location of bolts, flanges etc. on adjacent components.

We claim:

1. A combustion chamber for a gas turbine engine comprising at least one Helmholtz resonator having a resonator cavity and a resonator neck in flow communication with the interior of the combustion chamber, wherein the cavity extends around at least part of the neck and is spaced apart therefrom to define a cooling chamber therebetween.

2. A combustion chamber according to claim 1, wherein the neck and the cooling chamber are coaxial.

3. A combustion chamber according to claim 1, wherein the cooling chamber is annular.

4. A combustion chamber according to claim 1, wherein the cooling chamber has a closed end and an open end.

5. A combustion chamber according to claim 4, wherein the closed end has at least one purging hole that in use directs a flow of purging air into the cavity.

6. A combustion chamber according to claim 4, wherein the open end has at least one cooling hole that directs a flow of cooling air from the cooling chamber into the resonator neck.

7. A Helmholtz resonator for use in a combustion chamber of a gas turbine engine, having a resonator cavity and a resonator neck, wherein the cavity extends around at least part of the neck and is spaced apart therefrom to define a cooling chamber therebetween.

* * * * *